US005133835A

United States Patent [19]

Goettmann et al.

[11] Patent Number: 5,133,835

[45] Date of Patent: Jul. 28, 1992

[54] PRINTABLE, HIGH-STRENGTH, TEAR-RESISTANT NONWOVEN MATERIAL AND RELATED METHOD OF MANUFACTURE

[75] Inventors: James A. Goettmann, North East; John R. Boylan, Erie, both of Pa.

[73] Assignee: International Paper Company, Purchase, N.Y.

[21] Appl. No.: 489,427

[22] Filed: Mar. 5, 1990

[51] Int. Cl.[5] ..... D21H 13/10

[52] U.S. Cl. ..... 162/146; 162/164.4; 162/168.1; 162/169; 162/183

[58] Field of Search ..... 162/168.1, 146, 169, 162/183, 164.4

[56] References Cited

U.S. PATENT DOCUMENTS

| | | | |
|---|---|---|---|
| 3,097,991 | 7/1963 | Miller et al. | 162/157 |
| 3,158,532 | 11/1964 | Pall et al. . | |
| 3,489,643 | 1/1970 | Hoffman | 162/146 |
| 3,515,634 | 6/1970 | Sommer et al. | 162/146 |
| 4,162,180 | 7/1979 | Burton et al. | 156/220 |
| 4,210,487 | 7/1980 | Driscoll | 162/146 |
| 4,460,647 | 7/1984 | Keith | 428/369 |
| 4,615,689 | 10/1986 | Murray et al. | 493/51 |
| 4,894,280 | 1/1990 | Guthrie et al. | 428/224 |
| 4,973,382 | 11/1990 | Kinn et al. | 162/146 |
| 5,009,747 | 4/1991 | Viazmensky et al. | 162/146 |

FOREIGN PATENT DOCUMENTS

| | | |
|---|---|---|
| 787649 | 6/1968 | Canada . |
| 63159599 | 12/1986 | Japan . |
| 708622 | 7/1951 | United Kingdom . |

OTHER PUBLICATIONS

"Synthetic Fiber Papers proved in Pilot Mill Runs", *Paper Trade Journal*, Mar. 5, 1956, pp. 38,40.

Publication "Research Disclosure 102", Oct. 1972, pp. 24–25.

*Primary Examiner*—Peter Chin

*Attorney, Agent, or Firm*—Walt Thomas Zielinski; Michael J. Doyle

[57] ABSTRACT

A nonwoven composite web consists of 15 to 50 wt. % of first polyester fibers having a first length, a first denier and a first melting temperature; 15 to 50 wt. % of second polyester fibers having a second length, a second denier and a second melting temperature; 15 to 50 wt. % of third polyester fibers having a third length, a third denier and a third melting temperature; 10 to 35 wt. % of polypropylene fibers; and 1 to 25 wt. % of cellulose fibers. The first, second and third lengths are no less than ½ inch, the first, second and third denier are no less than 1.5, and the third melting temperature is less than the first and second melting temperatures respectively. The first and second polyester fibers, the polypropylene fibers and the cellulose fibers are bonded to each other at least in part by solidification of the third polyester fibers after subjecting the web to temperatures in excess of the third melting temperature but not in excess of the first and second melting temperatures. In particular, the web is thermally bonded by calendaring at a temperature of approximately 385° F. The web can be manufactured to have high opacity by adding titanium dioxide and silicone-acrylic latex to the composition. The titanium dioxide and latex are agglomerated and the resulting agglomerates are thermally bonded to the fiber matrix.

15 Claims, 9 Drawing Sheets

PRINTABLE, HIGH-STRENGTH, TEAR-RESISTANT NONWOVEN MATERIAL AND RELATED METHOD OF MANUFACTURE

FIELD OF THE INVENTION

This invention generally relates to high tensile strength synthetic nonwoven materials fabricated by wet-laid processes. In particular, the invention relates to a paper-like web composed of cellulosic, polyester and polypropylene fibers which provides a high strength printable protective wrap material.

BACKGROUND ART

High tensile strength paper-like webs made of synthetic nonwoven composites have diverse application as insulating housewrap, bookbinding and protective wrap materials. For such applications it is advantageous to provide a paper-like material which is printable and characterized by high tear resistance.

A known material suitable for use as a housewrap and other high strength applications is marketed under the brand designation TYVEK by E. I. Du Pont de Nemours and Company, Wilmington, Del. TYVEK is 100% spun bond polyethylene fiber bonded by heat and pressure. TYVEK style 1042B, which is marketed as a housewrap material, has the following properties: basis weight—26 lb/3000 $ft^2$; thickness—4.9 mils; tensile MD—20 lb/inch; tensile CD—22 lb/inch; tear MD; 0.7 lb; tear CD—0.7 lb; opacity—75%; internal bond—0.35 lb/inch.

U.S. Pat. No. 4,162,180 to Burton et al. discloses a flexible wall covering material comprised of pulp and two thermoplastic polymeric fibers having different plasticity temperatures. The polymeric fibers are selected from the group consisting of polyolefins, polyamides, polyesters, polyurethanes, polycarbonates, vinyl and acrylic resins. In wall covering applications, the sheet material is heated to a temperature intermediate the plasticity temperatures of the two thermoplastic materials, so that the fibers of one of the thermoplastic materials are rendered plastic and fuse together to form a three-dimensional network in the sheet while the other thermoplastic material retains its fibrous structure.

Canadian Patent No. 787,649 discloses nonwoven materials made of a mixture of three-dimensionally oriented fibers of different lengths. In accordance with the disclosure of this prior art, synthetic fibers, natural fibers and fibers made of inorganic materials can be used either alone or in a mixture with each other. The synthetic fibers may include polyamides, polyesters, polyacrylonitrile, polyvinyl chloride, polyvinylidene chloride, polyolefins and polyurethanes used alone or in mixture with each other. The Canadian patent discloses that the synthetic fibers can be of different lengths. In particular, in Examples 1 and 7 a nonwoven material is described which includes polyethylene terephthalate fibers of four different staple lengths. Example 4 is directed to a nonwoven material which includes polyethylene terephthalate fibers of six different staple lengths.

It is a broad object of the present invention to provide a paper-like web made of synthetic nonwoven composite material which has improved printability, strength and tear resistance and related method of its manufacture.

It is another object of the invention to provide a paper-like web made of synthetic nonwoven composite material suitable for housewrap and other protective covering applications.

Another object of the invention is to provide a printable, high-strength, tear-resistant synthetic nonwoven composite web having high opacity.

A further object of the invention to provide an economical and efficient method for producing a paper-like web made of synthetic nonwoven composite material having improved printability, strength and tear resistance.

DISCLOSURE OF THE INVENTION

In the present invention, these purposes, as well as others which will be apparent, are achieved generally by providing a composite material comprising a cellulosic material such as wood pulp, and polypropylene and polyester fibers of various lengths, diameters and melting points. The polyester fibers have lengths and deniers, respectively, of ½" and 1.5 or greater. Component fibers and the wood pulp are combined with water into a homogeneous mixture and formed into a mat employing a wet-lay process. A high strength paper-like material is formed by thermally bonding the mat under controlled temperature and pressure conditions.

A preferred composite of the invention comprises two polyester fibers of different length and denier, a third polyester fiber which function as a binder, polypropylene pulp or staple fiber, and wood pulp. The three polyester fibers may each constitute between 15 and 50 wt. % of the composite material. The polypropylene fiber and wood pulp, respectively, may vary from 10 to 35 wt. % and 1 to 25 wt. %. of the composite. The wood pulp imparts wet strength to the composite in the wet-lay formation of the composite sheet; the polypropylene fiber similarly imparts structural bonds to the composite during drying in the wet-lay process prior to thermal calendaring.

Strength and porous characteristics are imparted to the composite by the combination of polyester fibers employed in the invention. In particular, the strength of the composite can be improved by varying the polyester fiber content in accordance with the following functional relations: (a) as the polyester denier increases at constant length and amount, the porosity, bulk and stiffness of the composite increase and the amount of fiber entanglement decreases; (b) as the polyester length increases at constant denier and amount, the tensile and tear strengths in the MD and CD directions and the Mullen burst strength increase and the stiffness decreases; and (c) as the quantity of polyester increases at constant denier and length, the tensile strength improves, Mullen burst and tear strengths, and porosity increase.

In accordance with the method of the invention, a wet-laid mat of the composite material is dried at temperatures in the range of 200°-285° F. and then thermally calendared with rolls heated to temperatures of 380°-395° F. and nip pressures of 50 psi or greater. The preferred weight per unit area of the composite following thermal calendaring is 55 pounds per 3000 $ft^2$.

In an alternative embodiment, a high opacity characteristic is imparted to the composite by including an inorganic filler and latex in the composition. Preferred inorganic filler materials include clay and titanium dioxide. The latex is precipitated on the inorganic filler and cellulose fibers by adding cations to the filler/cellulose/latex slurry. Thereafter, the pH of the resultant slurry is raised by the addition of anions. Ultimately latex/filler agglomerates are thermally bonded into the fiber matrix of the composite web by polyester binder fiber which melts during calendaring at a temperature in excess of the melting point of the polyester binder fiber.

Other objects, features and advantages of the present invention will be apparent when the detailed description of the preferred embodiments of the invention is considered in conjunction with the drawings.

BEST MODE OF CARRYING OUT THE INVENTION

In accordance with the invention, printable, high-strength, tear-resistant synthetic nonwoven composites are provided with either high or low opacity characteristics. The composite material comprises a cellulosic material such as wood pulp, and polypropylene and polyester fibers of various lengths, diameters and melting points. The polyester fibers have lengths and deniers, respectively, of ½" and 1.5 or greater. Component fibers and the wood pulp are combined with water into a homogeneous mixture and formed into a mat employing a wet-lay process. Opacity may be imparted to the composite by the addition of an inorganic filler such as clay or titanium dioxide and an inorganic binder to the composition mixture. A high strength paper-like material is formed by thermally bonding the mat under controlled temperature and pressure conditions.

Table I sets forth the specifications of representative materials which may be used in fabricating a preferred low opacity composite of the invention.

TABLE I

Low Opacity Composite - Material Specifications

| Component | Brand | Length/Denier | Weight (%) |
|---|---|---|---|
| Unrefined wood pulp | SWK | | 10.0 |
| Supplier: | Riverdale International Paper Co. Selma, Alabama | | |
| Polyester fiber | Type 101 | ½" × 1.5 | 25.0 |
| Supplier: | Hoechst Celanese Corporation Wilmington, Delaware | | |
| Polyester binder fiber | Type 259 | ½" × 3.0 | 20.0 |
| Supplier: | Hoechst Celanese Corporation | | |
| Polyester fiber | Type 101 | 1½" × 15.0 | 25.0 |
| Supplier: | Hoechst Celanese Corporation | | |
| Polypropylene fiber | Pulpex P.A.D. | 0.8–1.5 mm (length) 20–40 microns (diameter) | 20.0 |
| Supplier: | Hercules Incorporated Wilmington, Delaware | | |

Figure 1:
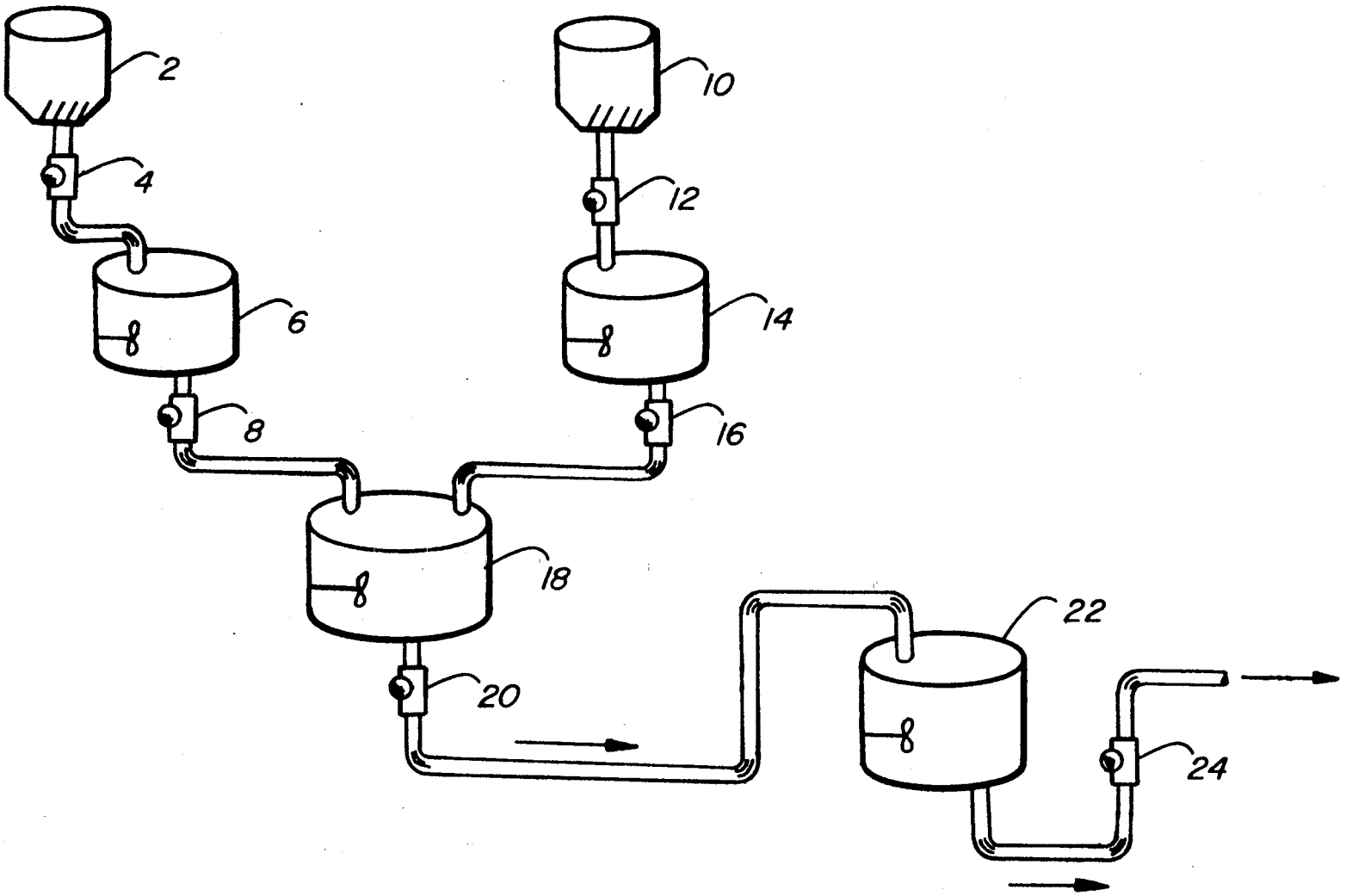
FIG. 1 is a diagrammatic view of an apparatus for preparation of stock or furnish for manufacture of the composite material of the invention.

FIG. 1 illustrates an apparatus for preparation of stock or furnish for manufacture of the composite material of the invention. A batch of cellulose and polypropylene is prepared in a hydropulper 2 by filling the hydropulper with warm water, agitating the water, adding wood pulp and polypropylene fiber, and then agitating the mixture for approximately 20 minutes. The cellulose/polypropylene slurry is then transported to a mixing chest 6 via a valve 4. In mixing chest 6 the cellulose/polypropylene slurry is diluted to the desired consistency, that is, 1.0 to 2.5%.

At the same time a polyester fiber slurry is prepared in hydropulper 10 which contains water. In preparation of the slurry, the water is agitated, a surfactant (Milease T supplied by ICI Americas, Inc., Wilmington, Del.) is added to provide a concentration of 0.5 lb. on fiber weight and the 1.5 and 3.0 denier polyester fibers are introduced into the slurry. Thereafter, the slurry is mixed for approximately 3 minutes to disperse the polyester fibers. As a web formation aid, an anionic polyacrylamide (2.0% solids based on fiber weight, Separan AP-273 supplied by Dow Chemical, Midland, Mich.) is added to the slurry followed by the 15.0 denier polyester fiber. The slurry is mixed for a sufficient time to disperse the polyester fiber in a uniform fashion. Visual inspection is used to determine when fibers are totally separated and well dispersed. The polyester slurry is then transported to mixing chest 14 via valve 12.

After the cellulose/polypropylene slurry has been suitably mixed in mixing chest 6 and the polyester fiber has been suitably mixed in mixing chest 14, the slurries are respectively transported to blending chest 18 where the mixture is blended and diluted to the desired consistency, i.e., 0.01 to 0.1%. The slurry is transported to the machine chest 22 via a valve 20 and, thereafter to the web-forming machine via valve 24.

Figure 2:
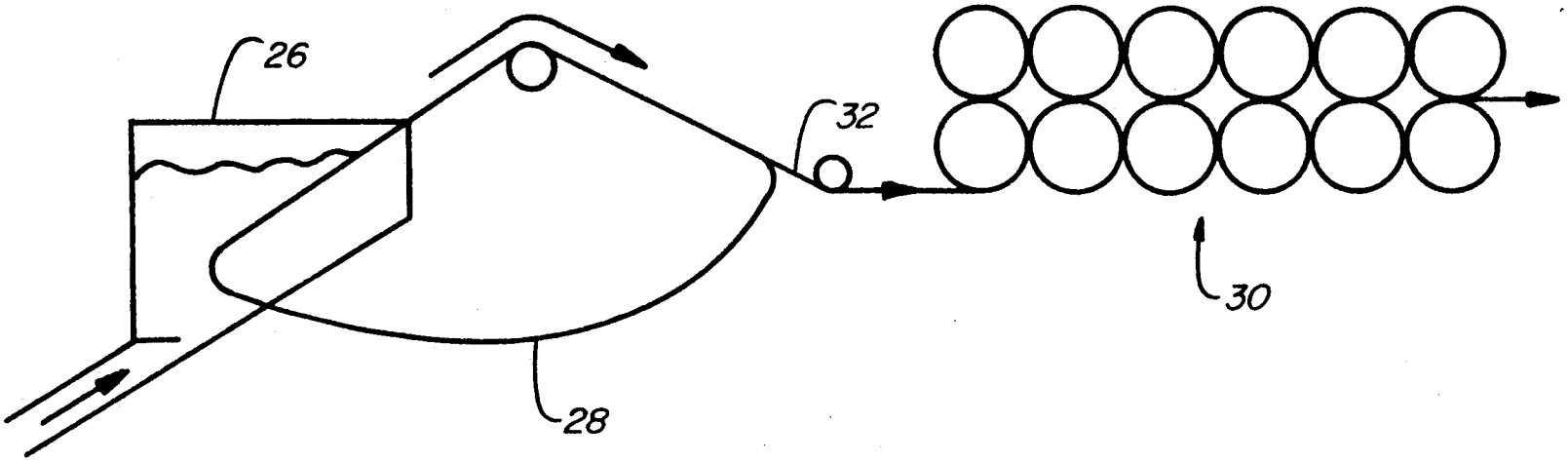
FIG. 2 is a diagrammatic view of an apparatus for formation and drying of a web employed in the manufacture of the composite material.

FIG. 2 is a diagrammatic view of an apparatus for formation and drying of a web employed in the manufacture of the composite. The homogeneous fiber slurry is received by headbox 26. A web 32 is formed by machine 28 using a wet-lay process in accordance with conventional paper-making techniques. Thereafter, the web 32 enters a stack of drying rollers 30, which remove water from the web. The dried web 32 is then wound up on a reel (not shown in FIG. 2) for further processing.

Figure 3:
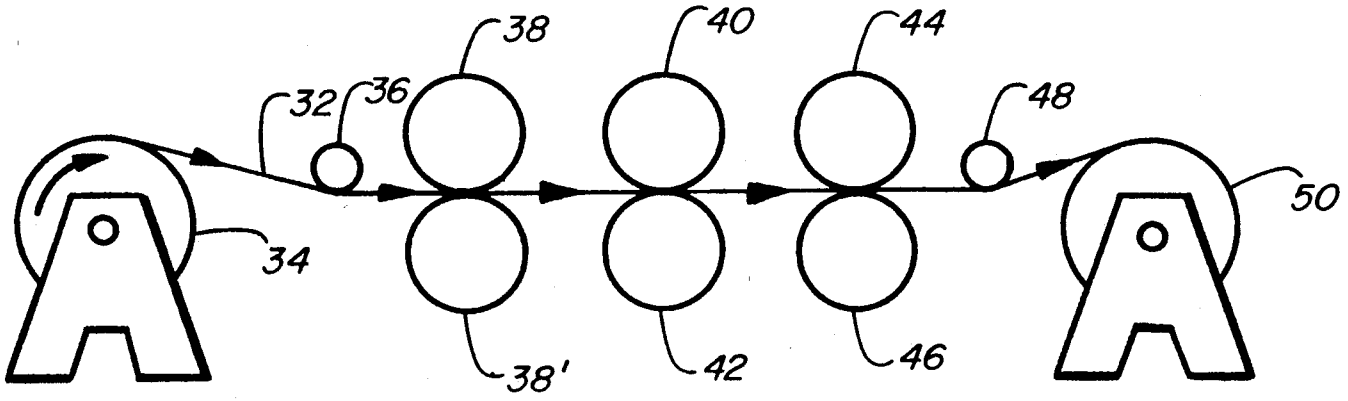
FIG. 3 is a diagrammatic view of an apparatus for thermally bonding the web to form the composite material of the invention.

A high strength and densified composite material is provided by thermally bonding the dried web 32 in a calendar. See FIG. 3. On the process line, the web 32 is unwound from the reel 34, and fed by guide roll 36 to the nip between calendar rolls 38 and 38'. Calendar rolls 38 and 38' which are preferably fabricated of steel and heated to a temperature and maintained at a compression pressure, respectively in the range of 360°–410° F.

and 40–70 psi. Preferred results are obtained at a temperature of approximately 385° F. and pressure of 50 psi.

Thereafter, the web in succession enters a second nip formed by a soft top roll 40 and a steel bottom roll 42 and a third nip formed by a steel top roll 44 and a soft bottom roll 46. The pressure at the second and third nips is 15–35 psi.

After passing between rolls 44 and 46, the thermally bonded web contacts guide roll 49 and is then wound up on reel 50. Table II sets forth physical properties of the low opacity composite of the invention following thermal bonding.

TABLE II

Physical Properties - Low Opacity Composite

| Tappi* No. | Physical Property | Un-calendared | Calendared |
|---|---|---|---|
| 410 | Basis Weight | | |
| | (3000 $ft^2$) | 56.6 | 58.2 |
| | (oz./$yd^2$) | 2.8 | 2.8 |
| 411 | Caliper (mils) | 18.0 | 6.6 |
| 251 | Porosity-Permeability, Frazier Air (cfm) | 163 | 9 |
| 543 | Taber V-5 Stiffness (MD/CD) | — | 1.3/0.9 |
| 403 | Mullen Burst (psi) | 11 | 95 |
| 414 | Elmendorf Tear (gm) (MD/CD) | Tears to length | Will not tear |
| 511 | MIT Fold (MD/CD) | — | 2000+/2000+ |
| 494 | Instron Tensile (lb/in.) (MD/CD) | 1.7/1.7 | 17.5/16.0 |
| 494 | Elongation (%) (MD/CD) | — | 12.7/13.5 |
| 494 | TEA (ft-lb/$ft^2$) (MD/CD) | — | 19.5/24.1 |
| 452 | GE Brightness | 88.7 | 88.9 |
| 425 | Opacity (%) | 69.7 | 58.2 |

*Standards of the Technical Association of the Pulp and Paper Industry ("TAPPI"), Technology Park, Atlanta, Georgia.

Figure 4:
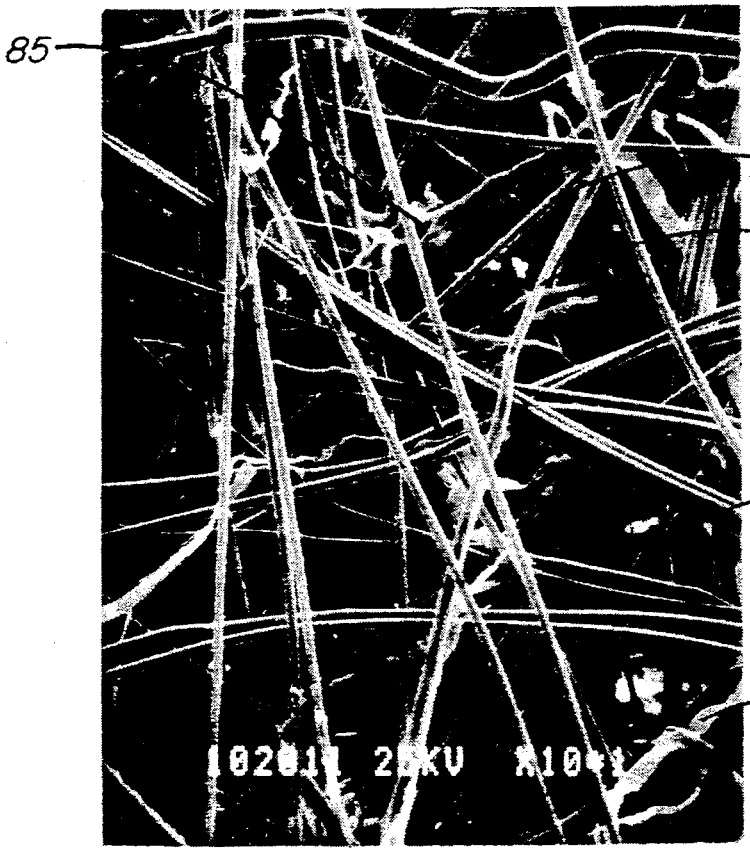
FIGS. 4–6 are photomicrographs, respectively at 10×, 50× and 75× magnification of a first low-opacity embodiment of the invention showing the microstructure of an unbonded web material.
Figure 5:
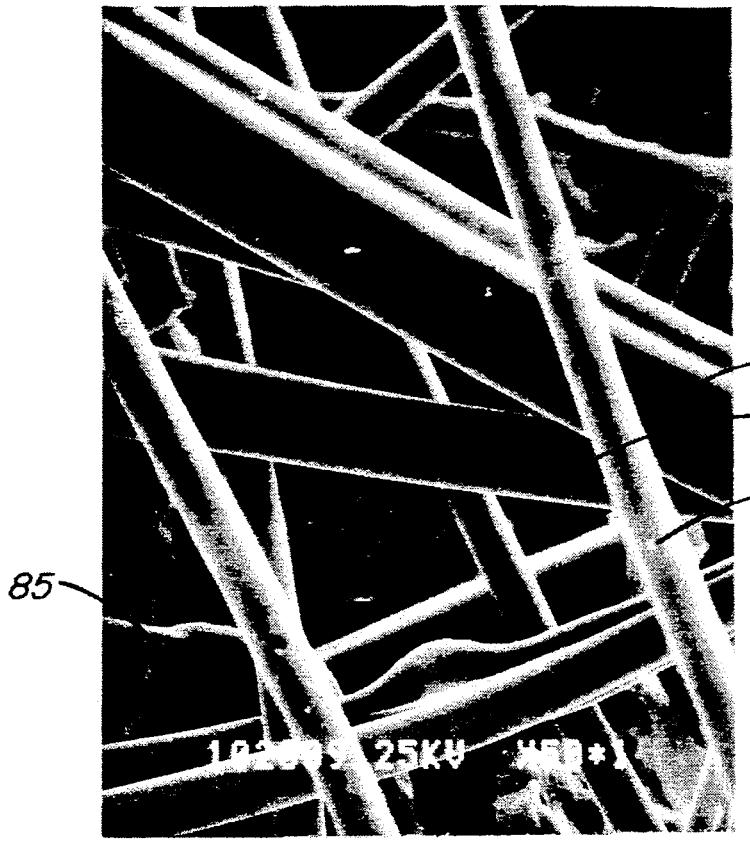
Figure 6:
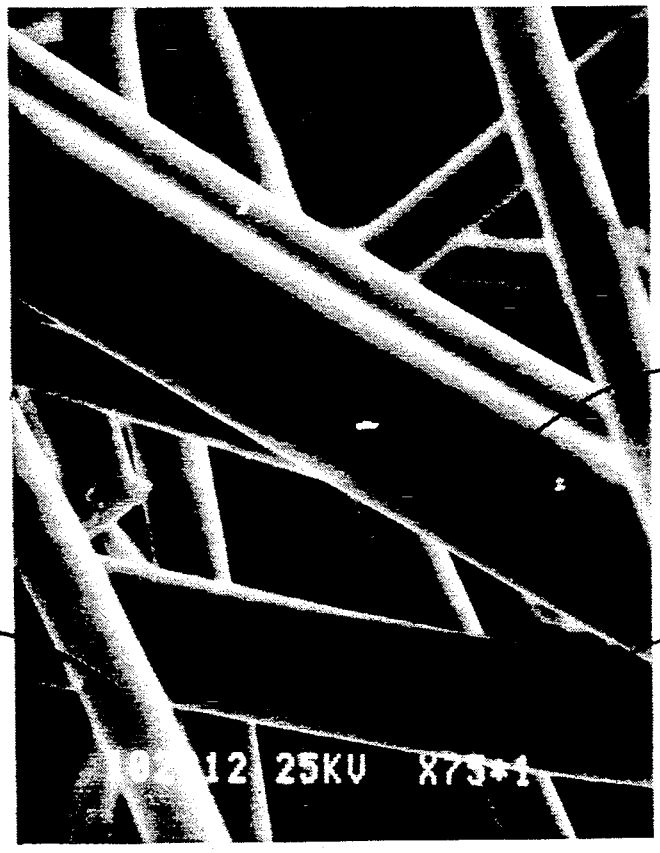

FIGS. 4–6 are photomicrographs of the unbonded low opacity web composite material, respectively taken at magnifications of 10×, 50×and 75×. Fiber components in the composite material are identified in the photomicrographs as follows: cellulose 60, 1.5 denier polyester 70, 15.0 denier polyester 75, 3.0 denier polyester binder fiber 80, and melted polypropylene 85. The uncalendared web has a microstructure of entangled individual fibers, that is, the polyester binder fibers do not exhibit bonding at fiber interfaces in the web matrix. As best shown in FIG. 6, the web includes void areas in inter-fiber spaces.

Figure 7:
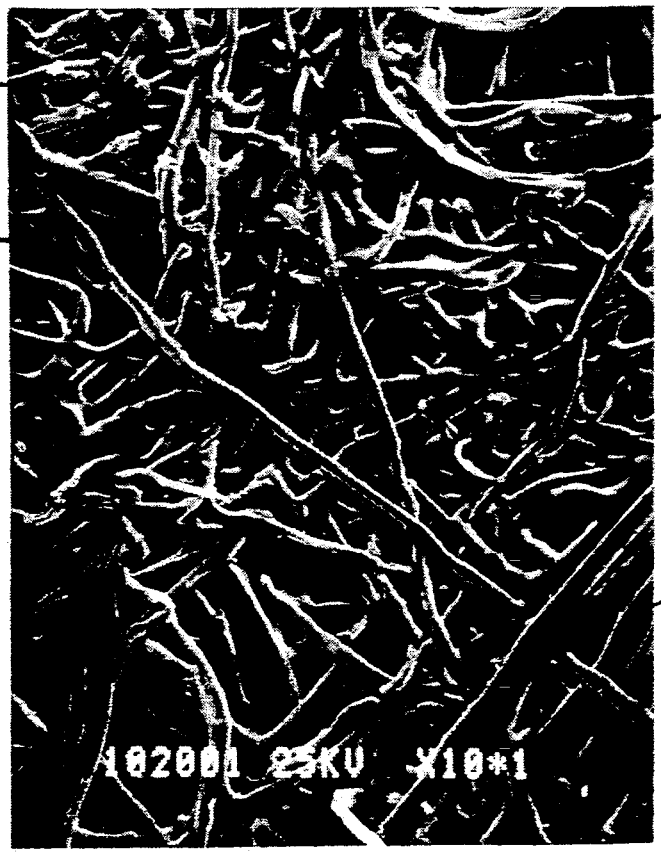
FIGS. 7–9 are photomicrographs, respectively at 10×, 50× and 75× magnification, of a low opaque composite formed by thermal bonding of the web material of FIGS. 4–6.
Figure 8:
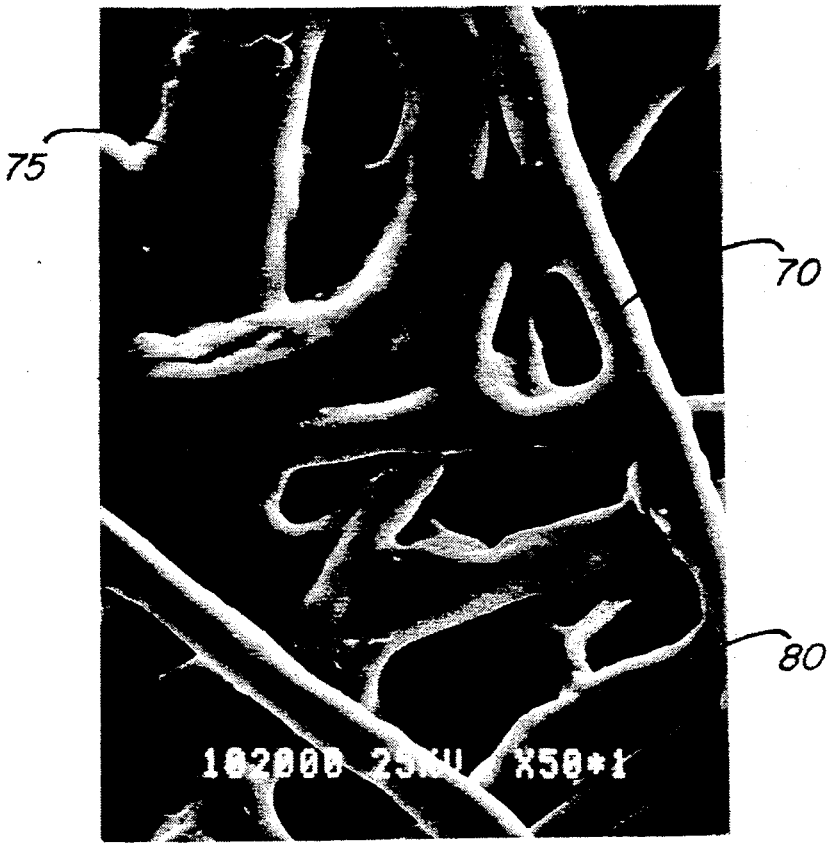
Figure 9:
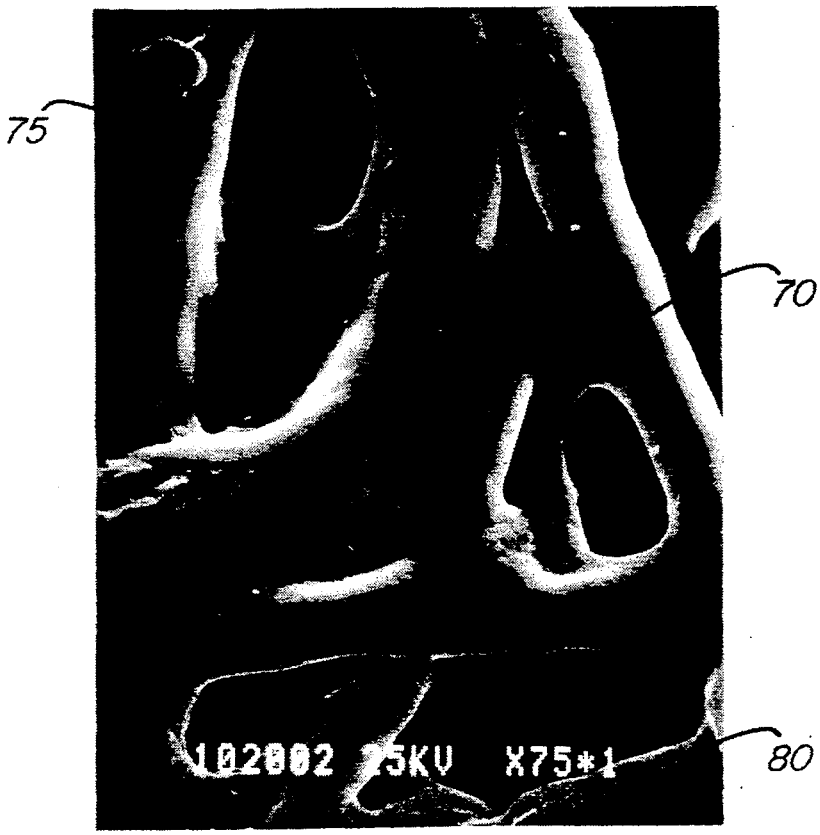

FIGS. 7–9 are photomicrographs of the thermally bonded low opacity composite of FIGS. 4–6 taken at like magnifications. The calendared composite exhibits a microstructure in which fiber interfaces are fused due to melting of the polyester binder fiber. Comparison of FIGS. 4–6 and 7–9, and in particular FIGS. 6 and 9, illustrates reduction in fiber spacing, i.e., fiber compression and bonding, which is effected in the calendaring the composite web. Density of the web material and the flatness (levelness) of the surface of the web material are substantially enhanced in the calendaring process.

Table III sets forth the specifications for representative materials which may be used in fabricating a high opacity composite in accordance with the invention.

TABLE III

High Opacity Composite - Material Specifications

| Component | Brand | Length/Denier | Weight (%) |
|---|---|---|---|
| unrefined wood pulp | SWK | | 9.0 |
| Supplier: | Riverdale International Paper Co. Selma, Alabama | | |
| Polyester fiber | Type 101 | ½" × 1.5 | 22.5 |
| Supplier: | Hoechst Celanese Corporation Wilmington, Delaware | | |
| Polyester binder fiber | Type 259 | ½" × 3.0 | 18.0 |
| Supplier: | Hoechst Celanese Corporation | | |
| Polyester fiber | Type 101 | 1½" × 15.0 | 22.5 |
| Supplier: | Hoechst Celanese Corporation | | |
| Polypropylene fiber | Pulpex | 0.8–1.5 mm | 18.0 |
| | P.A.D. | 20–40 microns (diameter) | |
| Supplier: | Hercules Incorporated Wilmington, Delaware | | |
| Zopaque Titanium dioxide powder | | | 9.0 |
| Supplier: | Glidden Pigments Baltimore, Maryland | | |
| Silicone-acrylic latex | A-1200 | | 1.0 |
| Supplier: | Multipolymer Corp. Coventry, Rhode Island | | |

A-1200 silicone-acrylic latex is a silicone-acrylic multipolymer which consists of an acrylated silicone oligomer covalently bonded to an acrylic resin. Covalent bonding of the resin composition produces a binder having improved thermal stability, specific adhesion, and resistance to aging, mechanical stress, chemical degradation and water. A-1200 latex is made by a conventional emulsion polymerization process. An essential ingredient in the binder is an acrylated vinyl silane which is block and inter-chain reacted with acrylic monomers to form a stable latex dispersion in water.

The high-opacity composite is manufactured on the process line employed in the low opacity composite. See FIGS. 1–3. Opacity is imparted to the composite by the addition to the material web slurry of an inorganic filler such as clay or titanium dioxide and an organic binder.

Slurry processing in the high opacity composite is fabricated from polyester fiber and polypropylene/cellulose furnishes employed in the low opacity composite. The polyester furnish composition and process of formulation is the same in the low and high opacity composite. The polypropylene/cellulose furnish differs in that the wood pulp is slurried in hydropulper 2 and then pumped to mixing chest 6, where the wood pulp slurry is diluted to approximately 400 gallons, i.e., to a consistency of 0.5–1.0%. Titanium oxide is then added to the diluted wood pulp slurry and the resulting mixture is agitated for approximately 5 minutes or until the powder is uniformly dispersed. A-1200 silicone-acrylic latex is then added to mixing chest 6. The contents of mixing chest 6 are again agitated—this time for approximately 3 minutes to effect uniform dispersion.

Thereafter, the pH of the filler/cellulose/latex slurry is slowly reduced to 4.5 by the addition of cationic material, preferably alum. Deposition is checked by allowing a small sample to settle in a beaker and visually examining the supernatant. If the supernatant is clear, the pH of the filler/cellulose/latex slurry is slowly raised to 6.33–6.5, preferably by the addition of 1N NaOH solution.

The physical properties of the filler/cellulose/latex portion of the furnish only are as follows: GE brightness, 85.6%; opacity, 97.0%; HunterLab: L, 94.22; a, −0.47; b, 1.52 (HunterLab Model D25-9, manufactured by Hunterlab Optical Engineers, Reston, Va.).

The polypropylene fibers are slurried in hydropulper 2 for 20 minutes and then pumped into mixing chest 6. The contents of mixing chest 6 are then diluted to the desired consistency. The pH is checked to ensure that a pH of 6.3–6.5 is maintained.

The polyester fiber furnish is prepared in hydropulper 10 and mixing chest 14 as previously described in connection with the low-opacity preferred embodiment. The filler/cellulose/latex/polypropylene slurry and the polyester fiber furnish are blended in blending chest 18, the slurry being diluted to the desired consistency to obtain the final furnish from which the high-opacity web will be made. The high-opacity web is formed and thermally bonded as described in connection with FIGS. 2 and 3.

Table IV sets forth physical properties of the high opacity composite of the invention in a calendared state.

TABLE IV

Physical Properties - High Opacity Composite

| Tappi No. | Physical Property | Un-calendared | Calendared |
|---|---|---|---|
| 410 | Basis Weight | | |
| | (3000 $ft^2$) | 100.8 | 114.0 |
| | (oz./$yd^2$) | 4.9 | 5.5 |
| 411 | Caliper (mils) | 22.3 | 14.0 |
| 251 | Porosity-Permeability, Frazier Air (cfm) | 91 | 8 |
| 543 | Taber V-5 Stiffness (MD/CD) | — | 11.2/8.2 |
| 403 | Mullen Burst (psi) | 30 | 215 |
| 414 | Elmendorf Tear (gm) (MD/CD) | 425/469 | Will not tear |
| 511 | MIT Fold (MD/CD) | — | 2000+/2000+ |
| 494 | Instron Tensile (lb/in.) (MD/CD) | 2.0/2.6 | 19.4/15.3 |
| 494 | Elongation (%) (MD/CD) | — | 7.2/10.1 |
| 494 | TEA (ft-lb/$ft^2$) (MD/CD) | — | 9.6/10.5 |
| 452 | GE Brightness | 88.2 | 89.5 |
| 425 | Opacity (%) | 80.7 | 83.0 |

Figure 10:
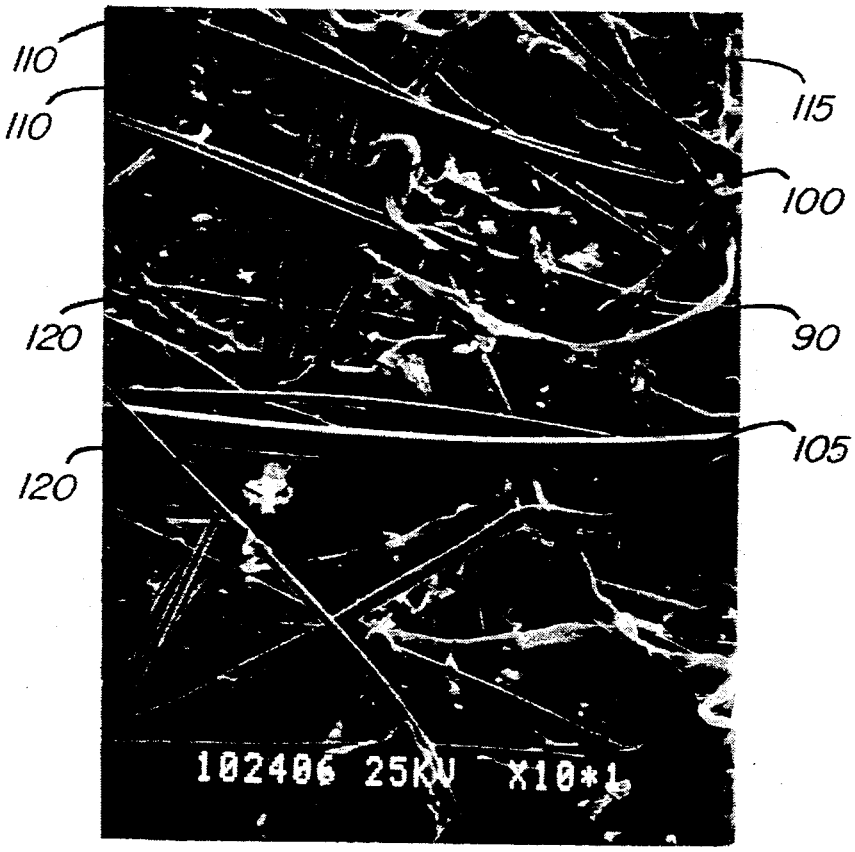
FIGS. 10–12 are photomicrographs, respectively at 10×, 50× and 75× magnification of a second high opacity embodiment of the invention showing the microstructure of an unbonded web material.
Figure 11:
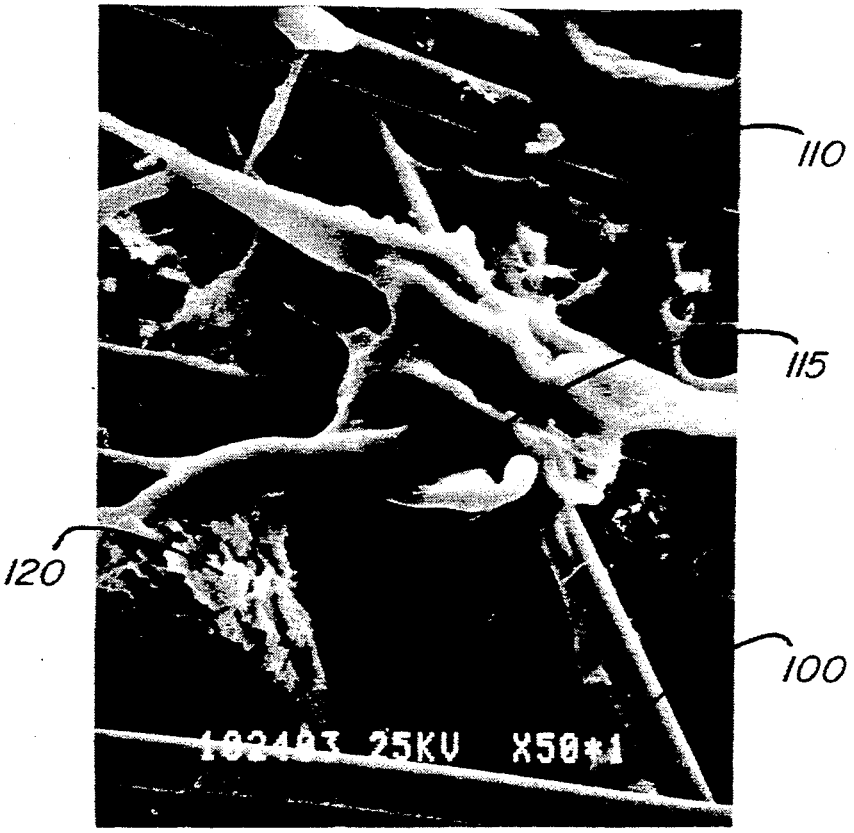
Figure 12:
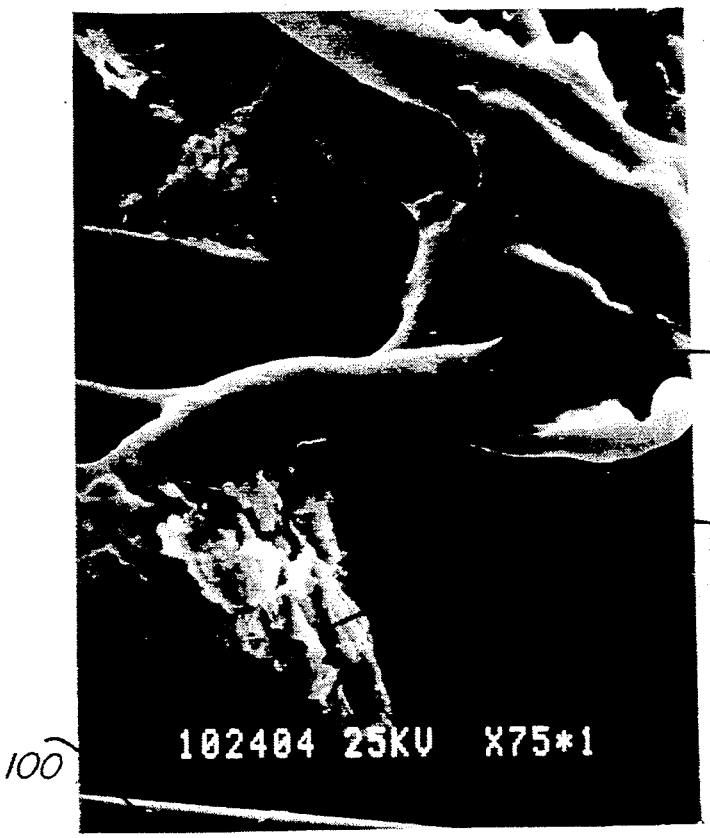

FIGS. 10–12 are photomicrographs of the unbonded high opacity web composite material, respectively taken at magnifications of 10×, 50× and 75×. Fiber components in the composite material are identified in the photomicrographs as follows: cellulose 90, 1.5 denier polyester 100, 15.0 denier polyester 105, 3.0 denier polyester binder fiber 110, polypropylene (melted) 115, and latex/filler agglomerates 120. It will be observed that as in the case of the opaque composite, the web includes a microstructure of entangled unbonded fibers which include void areas at fiber interfaces. See FIG. 12.

Figure 13:
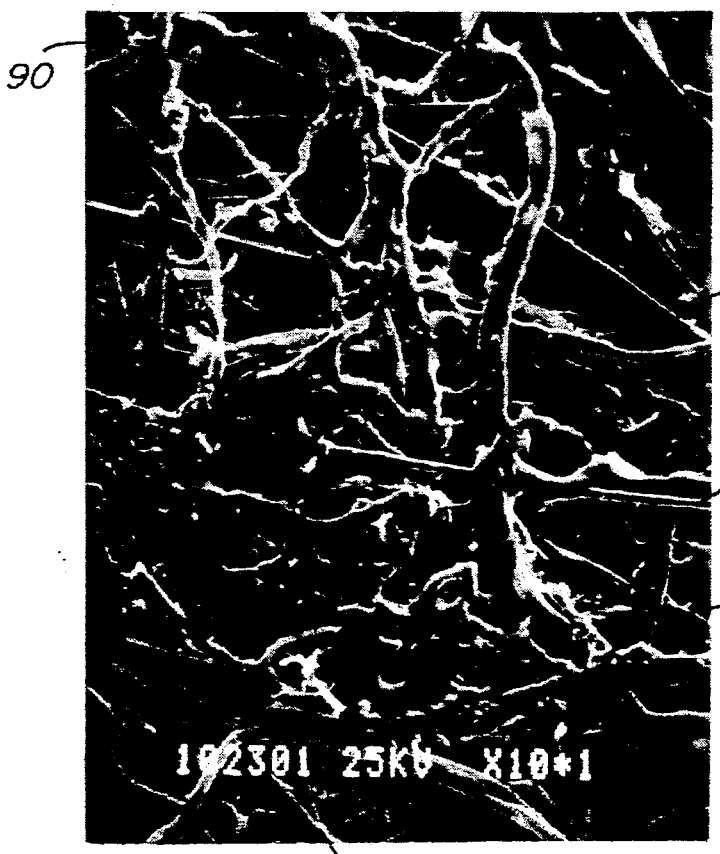
FIGS. 13–15 are photomicrographs, respectively at 10×, 50× and 75× magnification, of a high opacity composite formed by thermal bonding of the web material of FIGS. 10–12.
Figure 14:
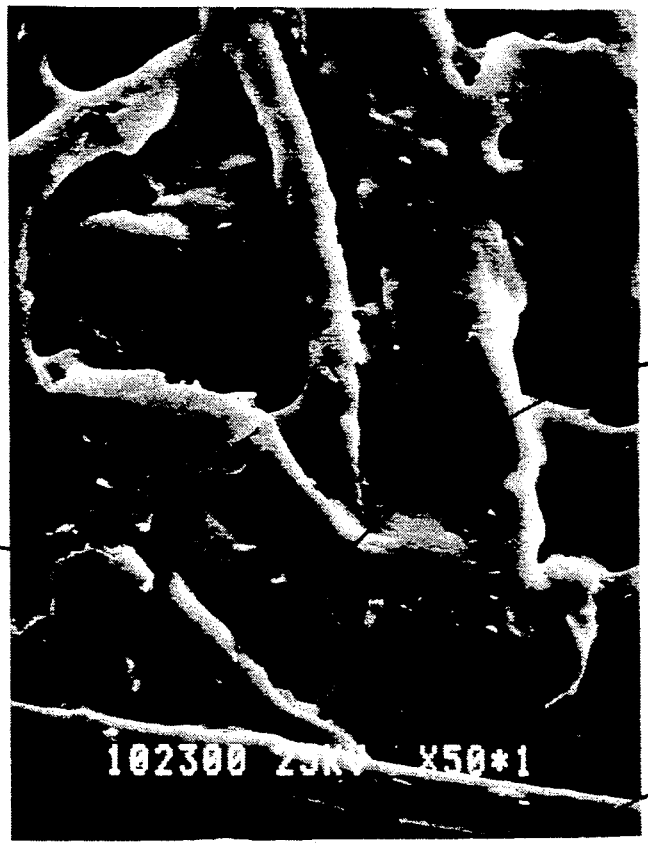
Figure 15:
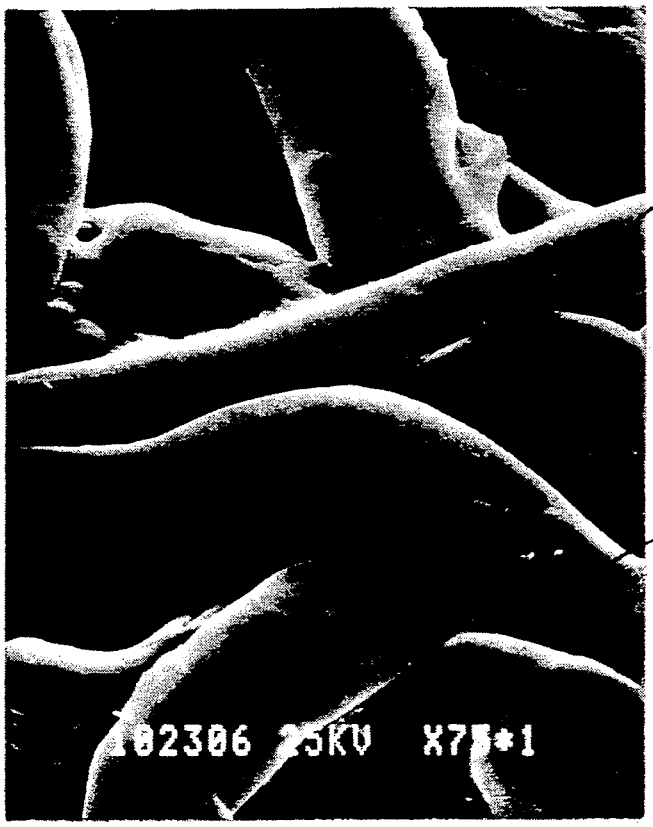

FIGS. 13–15 are photomicrographs of the thermally bonded high opacity composite of FIGS. 10–12 taken at like magnifications. Density in the calendared opaque composite is comparable to that obtained in the low opacity composite. It will observed that the latex/filler agglomerates are bonded into the matrix of the composite by the solidification of the polyester binder fiber. See FIG. 12.

The foregoing preferred embodiments have been described for the purpose of illustration only and are not intended to limit the scope of the claims hereinafter. Variations and modifications of the composition and method of manufacture may be devised which are nevertheless within the scope and spirit of the invention as defined in the claims appended hereto.

We claim:

1. A nonwoven composite web comprising:

15 to 50 wt. % of first polyester fibers having a first length, a first denier and a first melting temperature;

15 to 50 wt. % of second polyester fibers having a second length, a second denier and a second melting temperature;

15 to 50 wt. % of third polyester fibers having a third length, a third denier and a third melting temperature;

10 to 35 wt. % of polypropylene fibers; and 1 to 25 wt. % of cellulose fibers, wherein said first, second and third lengths are no less than ½ inch, said first, second and third denier are no less than 1.5, and said third melting temperature is less than said first and second melting temperatures respectively, said first and second polyester fibers, said polypropylene fibers and said cellulose fibers being bonded to each other at least in part by solidification of said third polyester fibers after subjecting said web to temperatures in excess of said third melting temperature but not in excess of said first and second melting temperatures.

2. The nonwoven composite web as defined in claim 1, wherein said first length is substantially equal to said third length and less than said second length, and said third denier is greater than said first denier and less than said second denier.

3. The nonwoven composite web as defined in claim 2, wherein said first length equals ½ inch, said second length equals 1 and ½ inches, said first denier equals 1.5, said second denier equals 3.0 and said third denier equals 15.0.

4. The nonwoven composite web as defined in claim 1, comprising 25 wt. % of said first polyester fibers, 25 wt. % of said second polyester fibers, 20 wt. % of said third polyester fibers, 20 wt. % of said polypropylene fibers and 10 wt. % of said cellulose fibers.

5. The nonwoven composite web as defined in claim 1, further comprising 5 to 25 wt. % of an inorganic filler taken from the group consisting of clay and titanium dioxide, and 1 to 25 wt. % of a polymer which is stable at temperatures in excess of 385° F., can be precipitated onto inorganic filler and cellulose by the addition of cations to a slurry and is not removed from inorganic filler and cellulose when precipitated thereon by the addition of anions to said slurry.

6. The nonwoven composite web as defined in claim 5, wherein said polymer is taken from the group consisting of acrylic and silicone-acrylic polymers.

7. The nonwoven composite web as defined in claim 5, wherein said polymer is a silicon-acrylic multipolymer.

8. The nonwoven composite web as defined in claim 5, comprising 9 wt. % of titanium dioxide and 1 wt. % of a silicon-acrylic multipolymer.

9. A method of manufacturing a nonwoven composite web comprising the following steps:

adding polypropylene fibers and cellulose fibers to water to form a polypropylene/cellulose slurry;

mixing first polyester fibers having a first length, a first denier and a first melting temperature, second polyester fibers having a second length, a second denier and a second melting temperature, third polyester fibers having a third length, a third denier and a third melting temperature and water to form a polyester fiber dispersion, said third melting temperature being greater than said first and second melting temperatures;

adding said polyester fiber dispersion and said polypropylene/cellulose slurry to form a furnish;

forming a web from said furnish by conventional papermaking techniques; and calendaring said web at a predetermined temperature in excess of said third melting temperature but less than said first and second melting temperatures.

10. The process as defined in claim 9, wherein said predetermined temperature is substantially equal to 385° F.

11. The process as defined in claim 10, wherein said first, second and third lengths are no less than ½ inch, and said first, second and third denier are no less than 1.5.

12. The process as defined in claim 9, wherein said first length is substantially equal to said third length and less than said second length, and said third denier is greater than said first denier and less than said second denier.

13. The process as defined in claim 12, wherein said first length equals ½ inch, said second length equals 1 and ½ inches, said first denier equals 1.5, said second denier equals 3.0 and said third denier equals 15.0.

14. The process as defined in claim 9, wherein said polyester fiber dispersion further comprises surfactant and anionic polyacrylamide.

15. The process as defined in claim 10, wherein said web is calendared at a pressure in excess of 50 psi.

* * * * *